US006404349B1

(12) United States Patent
Kaminosono

(10) Patent No.: US 6,404,349 B1
(45) Date of Patent: Jun. 11, 2002

(54) REMOCON LOCATOR SIGNAL TRANSMITTING DEVICE PROVIDED IN APPARATUS HAVING TELEVISION TUNER

(75) Inventor: Takeshi Kaminosono, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 09/201,355

(22) Filed: Dec. 1, 1998

(30) Foreign Application Priority Data

Dec. 2, 1997 (JP) ..... 9-331390

(51) Int. Cl.[7] ..... G08B 5/22

(52) U.S. Cl. ..... 340/825.49; 340/539; 340/571; 340/7.62; 348/731; 348/732; 348/733; 348/734

(58) Field of Search ..... 340/825.49, 539, 340/571, 7.62; 348/731, 732, 733, 734

(56) References Cited

U.S. PATENT DOCUMENTS 5,455,560 A * 10/1995 Owen ..... 340/539
5,506,717 A * 4/1996 Kho ..... 340/825.49
5,574,515 A * 11/1996 Ogasawara ..... 348/731
5,952,918 A * 9/1999 Ohayon ..... 340/825.49

* cited by examiner

*Primary Examiner*—Brian Zimmerman
*Assistant Examiner*—Yves Dalencourt
(74) *Attorney, Agent, or Firm*—Lackenbach Siegel, LLP

(57) ABSTRACT

A remocon locator signal transmitting circuit is provided in an apparatus having a television tuner. When a power for the apparatus is turned on, a micro-computer in the apparatus sets a local oscillation frequency of the television tuner at a predetermined frequency (390 MHz). A 390-MHz local oscillation signal is supplied from the television tuner through an input terminal to the remocon locator transmitting circuit. In the remocon locator transmitting circuit, the local oscillation signal is amplitude-modulated by a code signal applied from the input terminal so that a locator signal is transmitted from a loop antenna.

7 Claims, 3 Drawing Sheets

REMOCON LOCATOR SIGNAL TRANSMITTING DEVICE PROVIDED IN APPARATUS HAVING TELEVISION TUNER

BACKGROUND OF THE INVENTION

1. Field of the Invention

This invention relates to remocon (remote control) locator signal transmitting circuits, and more particularly to a remocon locator signal transmitting circuit provided in a television (TV) receiver, video cassette tape recorder (VCR) or the like, possessing, for example, a remocon locator function.

2. Description of the Prior Art

The remocon locator function means a function to issue a light or sound location notification signal from a remocon transmitter when it receives a radio wave (locator signal) transmitted by an apparatus main body thereby making clear a place where the remocon transmitter exists.

A conventional remocon locator signal transmitting circuit 1, as shown in FIG. 3, includes a transistor T1, having a base to which a locator code signal is applied from a control circuit (not shown). A control signal inverted by the transistor T1 is supplied to a base of a transistor T2 through a resistor R1, and also to an emitter of the transistor T2 through the resistors R1 and R2. The control signal is passed through the transistor T2 as a switch is supplied to a base of a transistor T3 through a resistor R3. When the control signal applied to the transistor T3 base is at a high level, a low level output is given to a printed circuit board (PCB) loop antenna 2. When the control signal to the transistor T3 base is at a low level, a high level output is supplied to the PCB loop antenna 2. An LC oscillation circuit is formed by the PCB loop antenna 2, a variable capacitor C1, and capacitors C2, C3 and C4 whereby a locator radio wave is transmitted from the PCB loop antenna 2. In this LC oscillation circuit the PCB loop antenna 2 acts as a reactance so that the frequency of the locator radio wave can be set at a predetermined frequency (390 MHz) by varying the capacitance of the variable capacitor C1. This predetermined frequency is assigned by the FCC (Federal Communications Commission), and a time period for which a radio wave is issued is specified within 4.9 seconds.

In this prior art, however, it has been necessary to adjust oscillation frequency on each assembly unit basis while taking into account circuit element characteristics. This is because a radio wave frequency has to be set by varying the capacitance of the variable capacitor C1. As a result, there have been problems in adjusting the oscillation frequency.

Furthermore, the capacitors C3 and C4 must be set in characteristic reverse to that of the transistor T2 in order to suppress temperature drift.

Moreover, it is necessary to use a glass epoxy PCB to stabilize the oscillation frequency at a predetermined frequency, resulting in higher costs.

SUMMARY OF THE INVENTION

Therefore, it is a primary object of the present invention to provide a remocon locator signal transmitting circuit which is inexpensive but stable in oscillation frequency.

A remocon locator signal transmitting circuit, according to the present invention, provided in an apparatus having a television tuner including a local oscillation circuit, comprises: a first input terminal for receiving an local oscillation signal with a predetermined frequency from the local oscillation circuit; a second input terminal for receiving a locator code signal; a modulating means for modulating the local oscillation signal by means of the code signal to output a locator signal; and a radio wave transmitting means for transmitting the locator signal as a radio wave.

Also, an electronic apparatus according to the present invention, comprises: a television tuner; a local oscillation means provided in the television tuner; a first input terminal for receiving a local oscillation signal from the local oscillating means; a second input terminal for receiving a locator code signal; a modulating means for modulating the local oscillation signal by means of the code signal to output a locator signal; and a radio wave transmitting means for transmitting the locator signal as a radio wave.

In the present invention, if a power for an electronic apparatus having the television tuner including the local oscillation means is turned on, the local oscillation signal is set in frequency at a predetermined frequency (390 MHz), for example, by a frequency setting means. Accordingly, an oscillation signal with the predetermined frequency is extracted at the local oscillation circuit onto the first input terminal. This oscillation signal is mixed (amplitude-modulated) with the locator code signal given onto the second terminal by the modulating means. This amplitude-modulation provides a locator signal by which a radio wave is transmitted from, for example, a PCB loop antenna to the remocon transmitter.

In the present invention, because a locator signal is created by utilizing a local oscillation signal obtained at the local oscillation circuit included in the television tuner, the component parts used is reduced in number and cost is low. Also, if the local oscillation circuit of the television tuner is configured for example by a PLL, frequency setting is easy and temperature drift is extremely low. Thus the frequency of the locator signal is stabilized.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
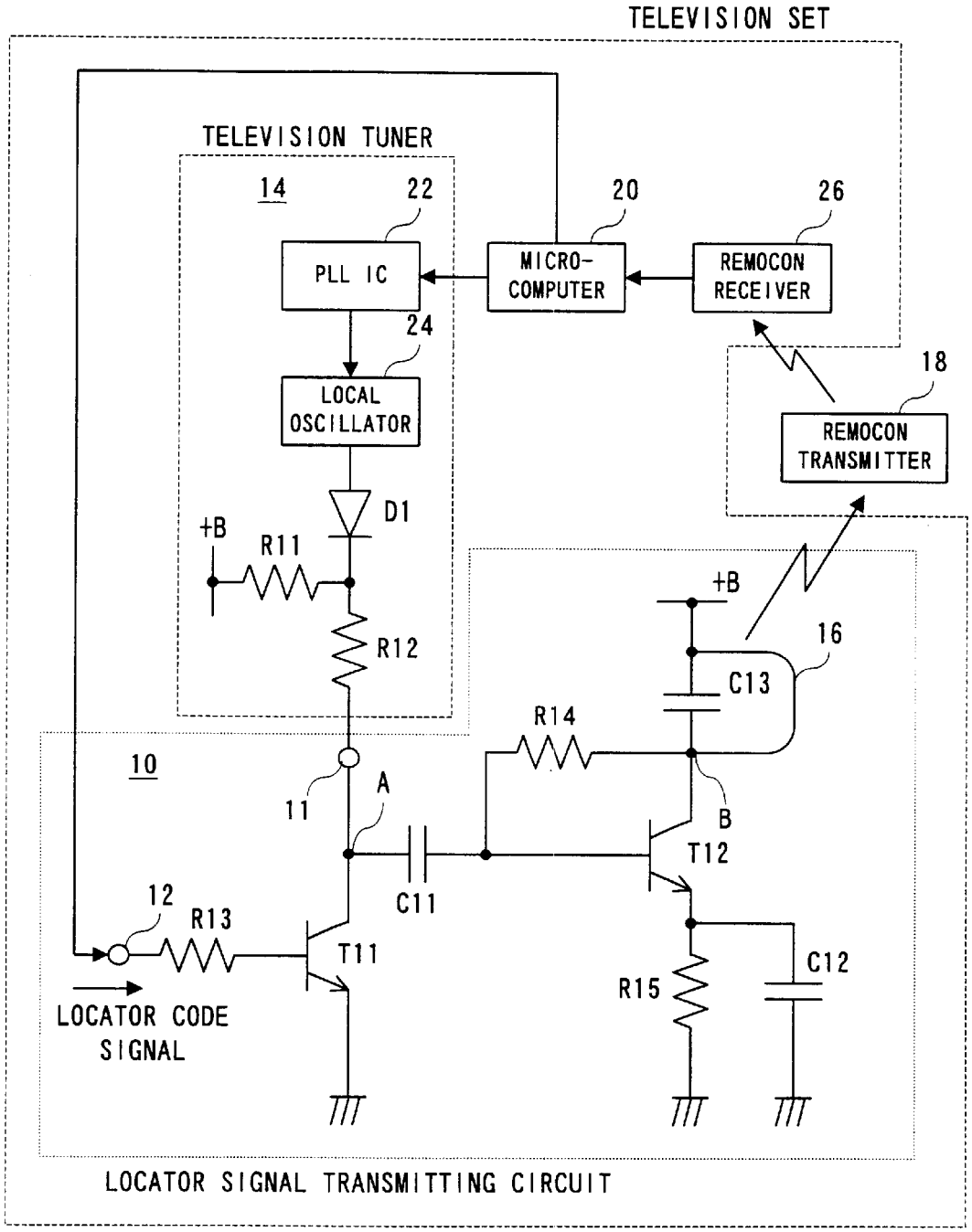
FIG. 1 is a circuit diagram showing one embodiment of the present invention.

Referring to FIG. 1, a remocon locator signal transmitting circuit 10 in this embodiment includes input terminals 11 and 12. Based on a control signal (locator code signal) supplied to the input terminal 12 as well as an output of a television tuner 14 given to the input terminal 11, a PCB loop antenna 16 outputs a locator radio wave to a remocon transmitter 18.

In the television tuner 14, a PLL (Phase Locked Loop) IC 22 is set at a predetermined frequency (390 MHz in this embodiment) according to an instruction by a micro-computer 20. Due to this, the oscillation frequency of an local oscillation signal is set at the predetermined frequency. Accordingly, the local oscillation circuit 24 provides an oscillation signal with the predetermined frequency onto the input terminal 11. This oscillation signal is superposed on a bias current flowing through a diode D1 to a resistor R11, and outputted to the remocon locator signal transmitting circuit 10 through a resistor R12. The diode D1 operates as a switching diode, and prevents the local oscillation frequency from flowing out of a tuner 14 when a transistor T11 is off.

The micro-computer 20 also outputs a locator code signal to the input terminal 12 of the remocon locator signal transmitting circuit 10. The locator code signal given onto the input terminal 12 is supplied through a resistor R13 to a base of a transistor T11. If it is assumed that a constant voltage source is connected to a point A, when the locator code signal is at a high level, the transistor T11 turns on to provide a low level output at the point A. On the other hand, when the locator code signal is at a low level, the transistor T11 turns off to give a high level output at the point A. In this embodiment because the point A is supplied with a high frequency (390 MHz) oscillation signal, the oscillation signal is amplitude-modulated by the locator code signal to thereby output an envelope signal through a point A. That is, when the locator code signal is at a high level, the amplitude of envelope is 0. However, when the locator code signal is at a low level, the amplitude of envelope has a predetermined level. In other words, the point A constitutes a modulating means which amplitude-modulate the local oscillation signal by means of the locator code signal.

The amplitude-modulated oscillation signal, i.e., locator signal, is applied to a base of a transistor T12 through a capacitor C11. Incidentally, the capacitor C11 prevents a d-c component contained in the amplitude-modulated oscillation signal from flowing into the transistor T12. When the amplitude-modulated oscillation signal is at a high level, the transistor T12 turns on to provide a low level output at a point B. On the other hand, when the amplitude-modulated oscillation signal is at a low level, the transistor T12 turns off thereby providing a high level output at the point B. That is, the amplitude-modulated oscillation signal, i.e., locator signal, is amplified by the transistor T12, and an amplified signal is outputted at the point B. Meanwhile, the transistor T12 and the resistor R14 forms a negative feedback circuit so that an amplified signal outputted at the point B is constant in voltage gain. Incidentally, if the transistor T12 is turned on, a d-c component of its emitter current flows through a resistor R15 while an a-c component thereof flows into a capacitor C12.

The amplified or locator signal outputted through the point B is supplied to an LC resonant circuit (antenna means) formed by the PCB loop antenna 16 and the capacitor C13. A locator signal is outputted as a radio wave from the PCB loop antenna 16 to the remocon transmitter 18. The LC resonant circuit, which is formed by the PCB loop antenna 16 and the capacitor C13, compensates for a high range characteristic of the radio wave outputted from the PCB loop antenna 16.

For example, if a main power for the present apparatus including the remocon locator signal transmitting circuit 10 and the television tuner 14 is turned on, the micro-computer 20 supplies a control signal to the PLL IC22 so that the PLL IC22 is set at 390 MHz. Accordingly, a oscillation signal of 390 MHz is extracted by the local oscillation circuit 24, and outputted onto the input terminal 11. The micro-computer 20 also supplies a locator code signal to the input terminal 12. Accordingly, a locator radio wave is transmitted from the PCB loop antenna 16 to the remocon transmitter 18. Receiving this radio wave, the remocon transmitter 18 issues, for example, a notification sound. This causes a user to recognize a location of the remocon transmitter 18. This function (remocon locator function) is effected for 4.9 seconds at maximum. However, if the user depresses an operation button, such as a channel button, provided on the remocon transmitter 18 before a lapse of 4.9 seconds, this function is suspended and the apparatus will operate according to an instruction by the button depressed. When the operating button on the remocon transmitter 18 is depressed, the control signal is delivered to the micro-computer through a remocon receiver 26.

Figure 2:
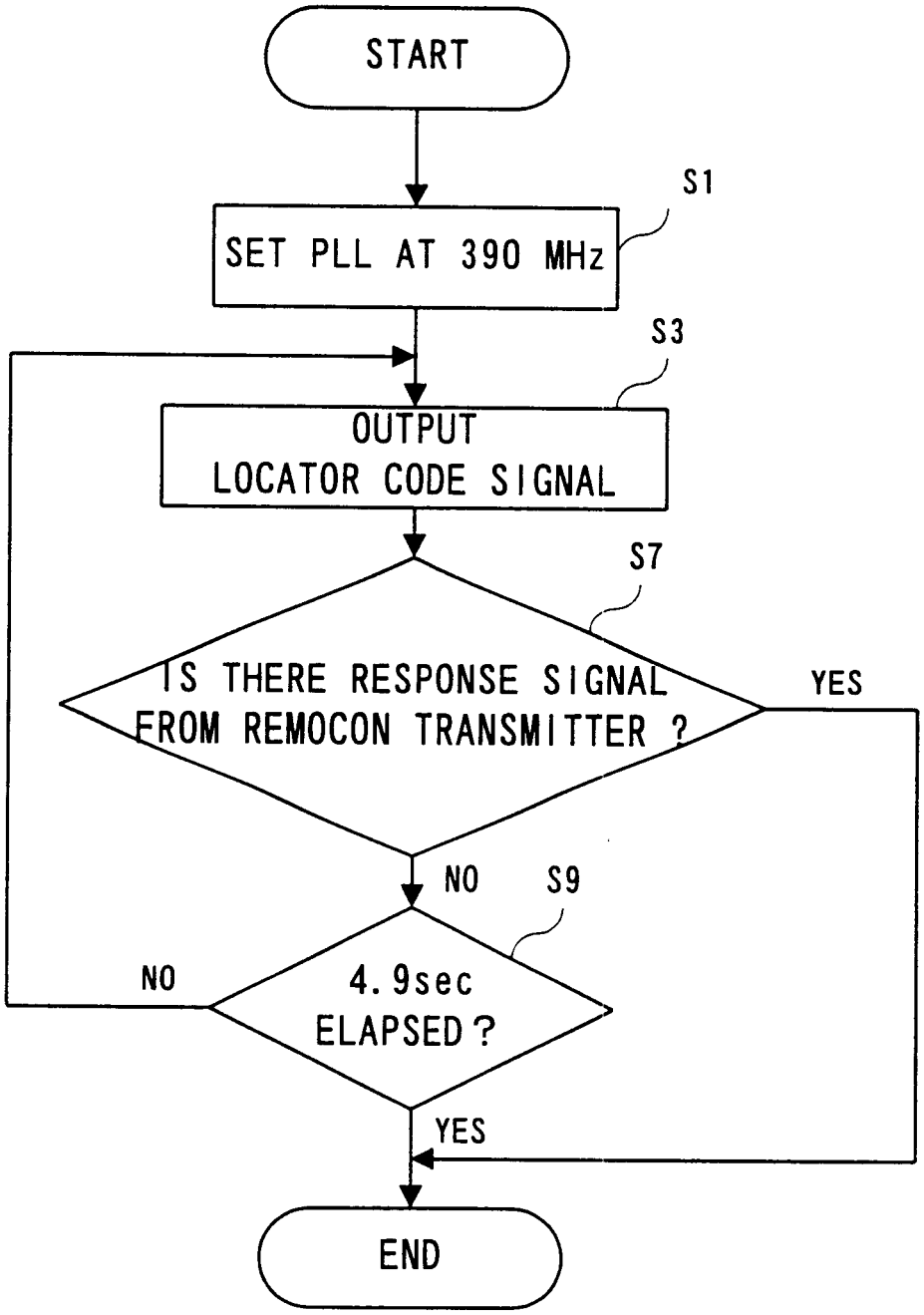
FIG. 2 is a flowchart showing part of a micro-computer process shown in the FIG. 1 embodiment.
Figure 3:
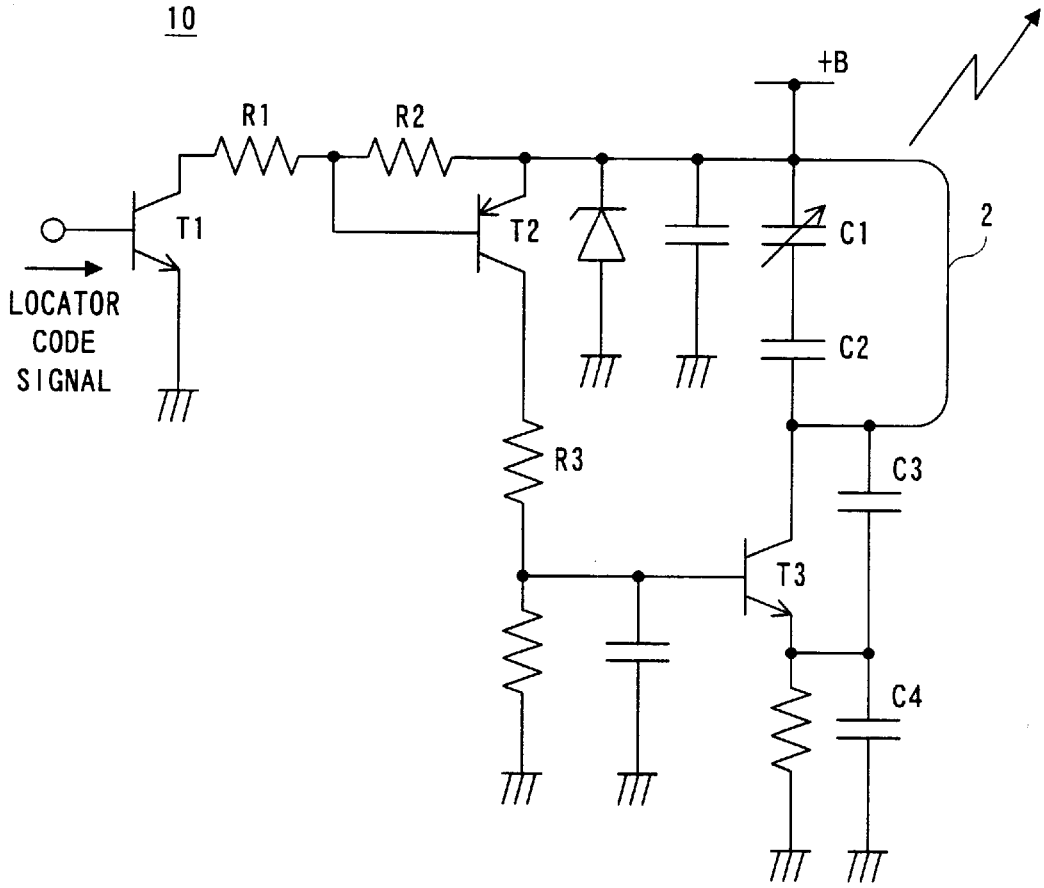
FIG. 3 PRIOR ART
FIG. 3 is a circuit diagram showing a conventional remocon locator signal transmitting circuit.

The micro-computer 20 processes for the operation as stated above, according to a flowchart shown in FIG. 2. That is, if the power of the apparatus is turned on, the process is started as shown in FIG. 2. At a step S1 the PLL IC22 is set at 390 MHz. At a succeeding step S3 a locator code signal is outputted, and it is determined at a step S5 whether there is an answer from the remocon transmitter 18 or not, that is, whether the operation button on the remocon transmitter 18 is depressed or not. If "YES" here, the process is ended. However, if "NO", it is determined at a step S7 whether 4.9 seconds has elapsed or not. If "YES", the process is ended, while if "NO", the process returns to the step S3.

According to this embodiment, an oscillation signal with a predetermined frequency can be extracted at the local oscillation circuit 24 included in the television tuner circuit 14 by the action of the PLL IC22. The oscillation frequency obtained is stable. Furthermore, the present circuit is reduced in number of component parts as compared with the conventional remocon locator signal transmitting circuit 1, thus making cost cheap.

In this embodiment when a radio wave is transmitted to the remocon transmitter 18 from the PCB loop antenna 16, the remocon transmitter 18 issues notification sound. Alternatively, a lamp may be provided on the remocon transmitter 18 so that the lamp is flickered, or the remocon transmitter 18 main body may be vibrated.

Although in the above embodiment explanation was made on the case with only one remocon transmitter 18, the invention is also applicable to a case having a plurality of remocon transmitters (for example, remocon transmitters are separately provided to operate TV receiver, VCR and the like). In such a case, the locator code signal is differently set for the TV-receiver remocon transmitter and VCR remocon transmitter. These locator code signals require to be previously assigned respectively to the TV-receiver remocon transmitter and the VCR remocon transmitter.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A remocon locator apparatus comprising:

a television tuner having a local oscillation circuit that is for selecting television channels and a transmitting circuit, said transmitting circuit comprising:

a first input terminal for receiving an oscillation signal with a predetermined frequency from said local oscillation circuit;

a second input terminal for receiving a locator code signal;

a modulator for modulating the local oscillation signal by means of the code signal to output a locator signal; and a radio wave transmitter for transmitting the locator signal as a radio wave.

2. A remocon locator signal transmitting circuit according to claim 1, wherein said modulating means includes an amplitude modulating means.

3. A remocon locator signal transmitting circuit according to claim 1, wherein said radio wave transmitting means includes an amplifying means for amplifying the locator signal and an antenna means for receiving an output of said amplifying means.

4. An electronic apparatus for locating a remocon having a television tuner, comprising:

a local oscillation circuit of said television tuner, said local oscillation circuit being for selecting television channels;

a first input terminal for receiving a local oscillation signal from said local oscillating means;

a second input terminal for receiving a locator code signal;

a modulator for modulating the local oscillation signal by means of the code signal to output a locator signal; and a radio wave transmitter for transmitting the locator signal as a radio wave.

5. An electronic apparatus according to claim 4, further comprising a frequency setting means for causing said local oscillating means to be set at a predetermined frequency when a power for said electronic apparatus is turned on.

6. A transmitting circuit according to claim 5, wherein said modulating means includes an amplitude modulating means.

7. A transmitting circuit according to claim 5, wherein said radio wave transmitting means includes an amplifying means for amplifying the locator signal and an antenna means for receiving an output of said amplifying means.

* * * * *